United States Patent [19]

Ishida

[11] 4,018,238

[45] Apr. 19, 1977

[54] COMB

[76] Inventor: Nobuaki Ishida, 9-24-6 Koganehara, Matsudo, Chiba, Japan

[22] Filed: Sept. 22, 1975

[21] Appl. No.: 615,434

[30] Foreign Application Priority Data

July 4, 1975 Japan ..... 70-46670

[52] U.S. Cl. ..... 132/143

[51] Int. Cl.[2] ..... A45D 24/08

[58] Field of Search ..... 132/148, 11, 103, 106, 132/123–124, 127, 143–144

[56] References Cited

UNITED STATES PATENTS

| | | | |
|---|---|---|---|
| 1,388,955 | 8/1921 | Kozlowsky | 132/143 X |
| 2,192,408 | 3/1940 | Lux | 132/143 |
| 2,260,093 | 10/1941 | Rainville | 132/143 |
| 2,260,093 | 10/1941 | Rainville | 132/143 |
| 2,559,867 | 7/1951 | Garofalo | 132/143 |
| 2,598,330 | 5/1952 | Wilson | 132/143 |
| 3,394,714 | 7/1968 | Kirwan | 132/11R |

*Primary Examiner*—G.E. McNeill
*Attorney, Agent, or Firm*—Fred Philpitt

[57] ABSTRACT

A hair device including a comb and a casing having a plurality of indentations and protrusions serially and longitudinally spaced to engage each other to detachably mount the casing on the comb. Large holes are provided on the casing to permit the passage of air from a hair drier to the hair.

1 Claim, 5 Drawing Figures

COMB

BRIEF SUMMARY OF THE INVENTION

The present invention relates to a comb which is unique in its construction in comparison with the known comb.

In case where one utilizes a comb in arranging his disheveled hair, he has to hold one of his hands over his hair so as to give a smooth or a push down effect to the hair. The reason being that the main purport of utilizing of the known comb resides in that the entanglement of the hair is straighten out.

Such necessity of holding one of the user's hands over his hair during utilization of the known comb will result in producing drawbacks in that the user's hand is soiled with hairdressing cream, oil or the like. It causes the user inconvenience particularly when he uses the comb in the open air.

Accordingly, it is an object of the present invention to provide a comb which does not require the user to hold one of his hands over his hair during the utilization thereof so that the user's hand may be prevented from being soiled with hairdressing cream, oil or the like.

BRIEF DESCRIPTION OF THE DRAWING

The nature of the present invention will become more fully apparent from a consideration of the following description of an exemplary embodiment thereof, taken in conjunction with the accompanying drawing, in which.

DETAILED DESCRIPTION OF THE INVENTION

Figure 1:
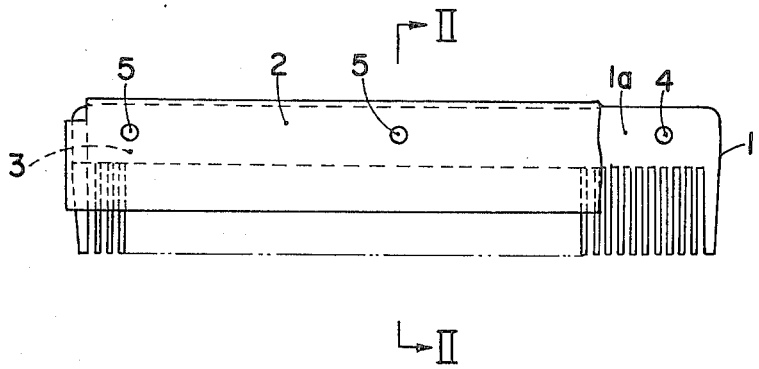
FIG. 1 is a front view showing one embodiment of the comb according to the present invention.

Referring now to FIG. 1 wherein one embodiment of the comb according to the present invention is shown, reference numeral 1 designates generally a comb and reference numeral 2 designates a cover or casing, the cover 2 being attached to the comb in such a manner that it could cover almost the entire portion of one side of the teeth of the comb, leaving only the forward end portion of the teeth.

The cover 2 which is made of plastic material, for example, is detachably attached to the comb 1. Among various ways which might be thought of in attaching the cover 2 to the comb 1, one preferable way will be to utilize the cover 2 having at its upper portion a return fitting member 3 which is to be resiliently and pressingly positioned on the upper marginal portion of the comb 1, as shown in the drawing.

Another preferable way will be to form a dent or dentation 4 in the non-teeth or back portion 1a of the comb 1 in order to receive a protrusion 5 projecting inwardly of the cover 2, whereby the cover 2 can be resiliently and fixedly combined with the comb 1. Accordingly, a plurality of indentations 4 and protrusions 5 are serially and longitudinally spaced on the back portion 1a and the casing 2, respectively and correspondingly engage each other in a snug manner.

Figure 2:
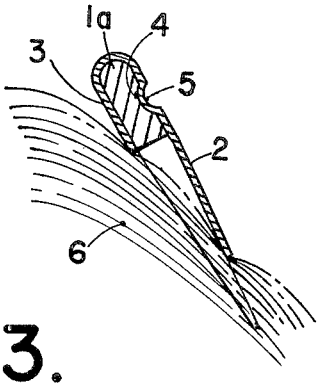
FIG. 2 is a section taken along the II-II line of FIG. 1 showing the situation wherein the comb is positioned on the hair.
Figure 3:
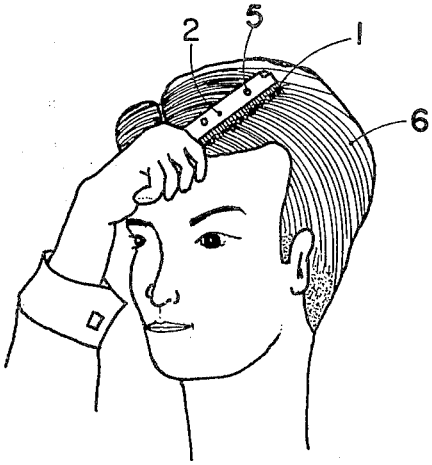
FIG. 3 is a pictorial view illustrating the manner how the comb is actually used.

As will be understood from the foregoing description, the comb 1 according to the present invention is provided with the cover 2 such that the cover 2 could cover almost entire portion of one side of the teeth of the comb, leaving only the forward end portion of the teeth. Thus, the hair 6 can be pressed down by the cover 2 during utilization of the comb, as shown in FIGS. 2 and 3.

Figure 4:
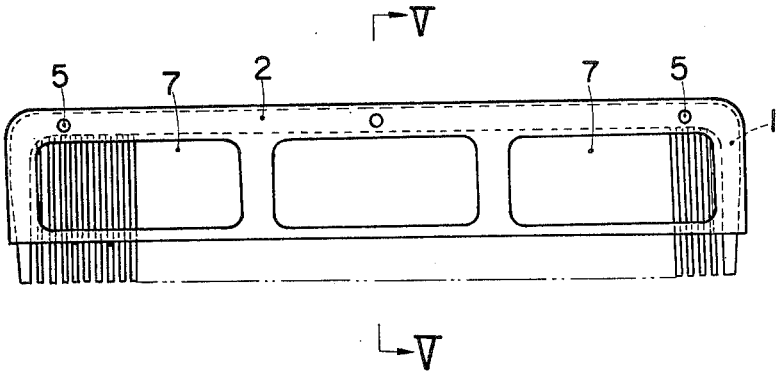
FIG. 4 is a front view showing another embodiment of the comb according to the present invention.
Figure 5:
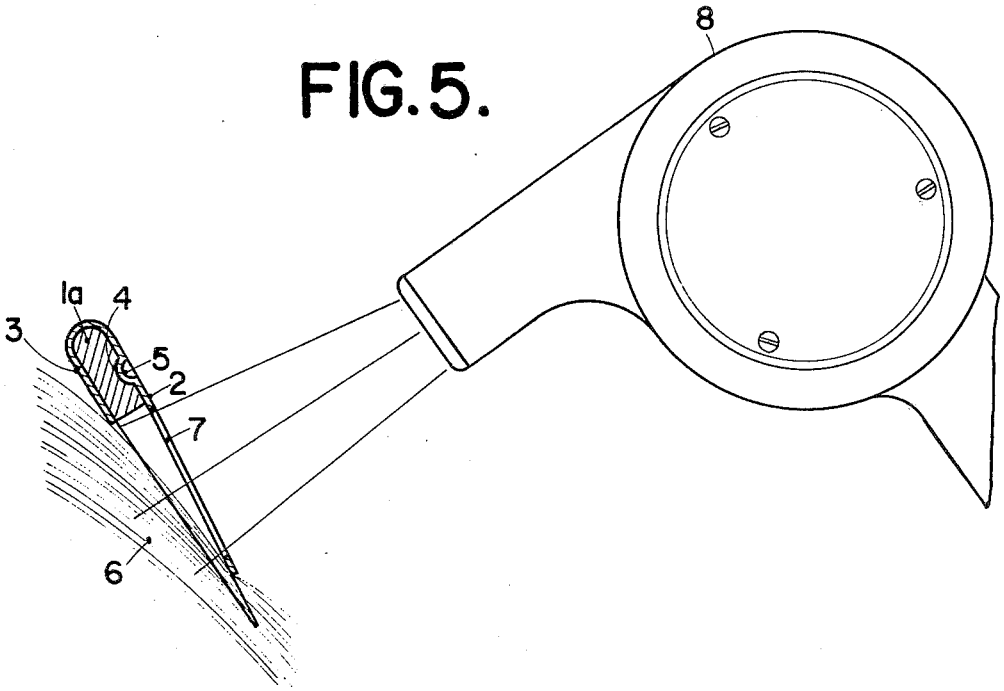
FIG. 5 is a section taken along the V—V line of FIG. 4 showing the situation wherein the comb is positioned on the hair.

FIGS. 4 and 5 show another embodiment according to the present invention. In this embodiment, the cover 2 is provided with a plurality of holes 7 with a view to providing convenience to the user when a hair-drier is used in combination with the comb. More specifically, the holes 7 are provided to pass therethrough the hot air directly from the hair-drier 8 to the hair without being objected to by the cover 2, wherefore the purport of the use of the hair-drier can effectively be attained.

Accordingly, the comb according to the present invention does not require the user to hold one of his hands over his hair during the utilization thereof.

Further advantage according to the comb of the present invention will be that broken hair which might stick to the comb during utilization thereof may easily be removed. More specifically, both broken hair stuck to the lower marginal portion of the cover 2 and broken hair remaining on the teeth of the comb can be removed together by moving up and down the cover 2 with respect to the teeth of the comb1, wherefore the comb 1 can easily be kept in good repair.

While the particular embodiment of the present invention has been shown and described, it will be obvious to those skilled in the art that changes and modifications may be made without departing from the invention in its broader aspects and, therefore, the aim in the appended claims is to cover all such changes and modifications as fall within the true spirit and scope of this invention.

What is claimed is:

1. A device for simultaneously combing and smoothing the hair which consists of a. a comb member that includes
   1. an elongated non-tooth body portion,
   2. a plurality of spaced apart teeth extending in a parallel row downwardly from said elongated body portion, and
   3. a plurality of longitudinally aligned indentations along one side of said nontooth body portion, and b. a cover member that includes
   1. an elongated generally U-shaped portion that fits over and along the edge of the elongated nontooth portion of the comb member that is farthest from the teeth of the comb, and
   2. an elongated generally flat section extending from said U-shaped portion downwardly over a substantial portion of the teeth of the comb member but short of the ends of the teeth so as to leave exposed the outer end portions of all of said comb teeth,
   3. a plurality of generally rectangular openings in said elongated flat section which are large enough to expose large areas of said teeth and permit the passage of hot air to the hair beneath the teeth of the comb, and
   4. a plurality of longitudinally aligned protrusions along the interior surface of said U-shaped portion, said protrusions being spaced apart so as to engage said indentations located on said nontooth body portion.

* * * * *